US007207662B2

(12) United States Patent
Shin et al.

(10) Patent No.: US 7,207,662 B2
(45) Date of Patent: Apr. 24, 2007

(54) INK-JET PRINTHEAD

(75) Inventors: Seung-joo Shin, Seoul (KR); Yong-soo Oh, Seongnam-si (KR); Su-ho Shin, Suwon-si (KR); Min-soo Kim, Seoul (KR); Hyung-taek Lim, Seoul (KR); Chang-seung Lee, Seongnam-si (KR); You-seop Lee, Yongin-si (KR); Keon Kuk, Yongin-si (KR)

(73) Assignee: Samsung Electronics Co., Ltd., Suwon-si, Gyeonggi-do (KR)

( * ) Notice: Subject to any disclaimer, the term of this patent is extended or adjusted under 35 U.S.C. 154(b) by 183 days.

(21) Appl. No.: 10/870,936

(22) Filed: Jun. 21, 2004

(65) Prior Publication Data

US 2005/0001883 A1 Jan. 6, 2005

(30) Foreign Application Priority Data

Jul. 3, 2003 (KR) ..... 10-2003-0044841

(51) Int. Cl.
*B41J 2/05* (2006.01)

(52) U.S. Cl. ..... 347/63; 347/56; 347/65

(58) Field of Classification Search ..... 347/56, 347/61, 63–65, 47, 54
See application file for complete search history.

(56) References Cited

U.S. PATENT DOCUMENTS 5,648,805 A * 7/1997 Keefe et al. ..... 347/65
5,734,399 A 3/1998 Weber et al. ..... 347/65
5,940,099 A 8/1999 Karlinski ..... 347/70
6,260,957 B1 7/2001 Corley et al. ..... 347/63
6,595,627 B2 * 7/2003 Min et al. ..... 347/65
6,886,919 B2 * 5/2005 Lim et al. ..... 347/56
2003/0090548 A1 5/2003 Min et al.

FOREIGN PATENT DOCUMENTS

EP 0 321 075 A2 6/1989
EP 0 321 075 A3 6/1989
EP 1215048 A2 * 6/2002
EP 1410912 A1 * 4/2004

* cited by examiner

*Primary Examiner*—Stephen Meier
*Assistant Examiner*—Lisa M. Solomon
(74) *Attorney, Agent, or Firm*—Lee & Morse, P.C.

(57) ABSTRACT

An ink-jet printhead includes a substrate having an ink chamber and a manifold, a nozzle plate formed on the substrate, first and second heaters and conductors, a material layer, and a plurality of ink channels. The nozzle plate includes a plurality of passivation layers formed of an insulating material, a heat dissipation layer formed on the plurality of passivation layers and made of a thermally conductive material, and a nozzle passing through the nozzle plate and in flow communication with the ink chamber. The first and second heaters and conductors are interposed between adjacent passivation layers of the nozzle plate. The material layer is interposed between the ink chamber and the manifold to form a bottom wall of the ink chamber and a top wall of the manifold. The plurality of ink channels is formed in the material layer to provide flow communication between the ink chamber and the manifold.

19 Claims, 10 Drawing Sheets

INK-JET PRINTHEAD

BACKGROUND OF THE INVENTION

1. Field of the Invention

The present invention relates to an ink-jet printhead. More particularly, the present invention relates to a thermal ink-jet printhead that is able to filter impurities and reduce an amount of time necessary to refill an ink chamber.

2. Description of the Related Art

In general, ink-jet printheads are devices for printing a predetermined image, color or black, by ejecting a small volume droplet of ink at a desired position on a recording sheet. Inkjet printheads are generally categorized into two types depending on which ink ejection mechanism is used. A first type is a thermal ink-jet printhead, in which heat is applied to form and expand a bubble in ink to cause an ink droplet to be ejected due to the expansion force of the formed bubble. A second type is a piezoelectric ink-jet printhead, in which an ink droplet is ejected by a pressure applied to the ink due to a deformation of a piezoelectric element.

A thermal ink-jet printhead is classified into a top-shooting type, a side-shooting type, and a back-shooting type depending on a bubble growing direction and a droplet ejection direction. In a top-shooting type of printhead, bubbles grow in the same direction in which ink droplets are ejected. In a side-shooting type of printhead, bubbles grow in a direction perpendicular to a direction in which ink droplets are ejected. In a back-shooting type of printhead, bubbles grow in a direction opposite to a direction in which ink droplets are ejected.

An ink-jet printhead using the thermal driving method should satisfy the following requirements. First, manufacturing of the ink-jet printheads should be simple, costs should be low, and should facilitate mass production thereof. Second, in order to obtain a high-quality image, cross talk between adjacent nozzles should be suppressed while a distance between adjacent nozzles should be narrow; that is, in order to increase dots per inch (DPI), a plurality of nozzles should be densely positioned. Third, in order to perform a high-speed printing operation, a period in which the ink chamber is refilled with ink after ink has been ejected from the ink chamber should be as short as possible and the cooling of heated ink and heater should be performed quickly to increase a driving frequency.

An ink droplet ejection mechanism of a thermal ink-jet printhead will now be explained in detail. When a pulse current is applied to a heater, which includes a heating resistor, the heater generates heat and ink near the heater is instantaneously heated to approximately 300° C., thereby boiling the ink. The boiling of the ink causes bubbles to be generated, and exert pressure on ink filling an ink chamber. As a result, ink around a nozzle is ejected from the ink chamber in the form of a droplet through the nozzle.

Once the bubbles burst and ink is ejected, an ink chamber requires a supply of an equal amount of new ink, which flows through an ink channel. The ink channel necessarily creates some resistance against the flow of the ink. Accordingly, the ink channel should be designed to reduce ink flow resistance while ink is flowing into the ink chamber. However, the ink channel should be designed to adjust the ink flow resistance to be sufficiently high to prevent the ink from flowing reversely, i.e., back flowing, when the ink droplet is ejected through the nozzle. Accordingly, the ink flow resistance of the ink channel and the nozzle require proper adjustment in consideration of the mobility of an ordinary ink droplet and the time necessary to refill the ink chamber.

FIG. 1 illustrates a conventional ink-jet printhead capable of filtering impurity particles. Referring to FIG. 1, ink is supplied to heaters 401 and 403 from a manifold 407 through ink channels 409, 411, 413, and 415. In this conventional configuration, the ink-jet printhead employs islands 417, 419, 423, 425, 427, 429, and 431, which are formed in ink paths using a photoresist, to prevent impurity particles 433 and 435 from reaching the heaters 401 and 403.

While this conventional ink-jet printhead, constructed as described above, is able to prevent the ink paths from being blocked with impurities, this printhead is not able to adjust ink flow resistance during an ink refill operation, i.e., during the time from when the ink droplet is ejected until the ink chamber is refilled.

Another conventional ink-jet printhead incorporates a porous material into an ink channel. It is known that the flow resistance of a porous material is proportional to the square of the velocity of the flow. Thus, an ink channel made of a porous material has an advantage in that when ink is ejected and fluid velocity is high, a flow resistance increases, and when ink is refilled and fluid velocity is low, a flow resistance decreases. However, such an ink-jet printhead using the porous material has high manufacturing costs and requires complex manufacturing processes.

Still another conventional ink-jet printhead includes a structure to filter impurities before ink is introduced into an ink chamber. However, in such a structure, an ink channel and a filter must be individually constructed.

SUMMARY OF THE INVENTION

The present invention is therefore directed to a thermal ink-jet printhead having an improved structure, which substantially overcomes one or more of the problems due to the limitations and disadvantages of the related art.

It is a feature of an embodiment of the present invention to provide an ink-jet printhead having a plurality of ink channels between an ink chamber and a manifold to reduce an amount of time necessary to refill an ink chamber, thereby increasing an operating frequency of the printhead.

It is another feature of an embodiment of the present invention to provide an ink-jet printhead that is capable of filtering impurities from ink to prevent malfunction of the printhead.

At least one of the above features and other advantages may be provided by an ink-jet printhead including a substrate having an ink chamber to be filled with ink to be ejected formed in an upper portion thereof and a manifold for supplying ink to the ink chamber formed in a lower portion thereof, a nozzle plate formed on the substrate, the nozzle plate including a plurality of passivation layers formed of an insulating material, a heat dissipation layer formed on the plurality of passivation layers and made of a thermally conductive material, and a nozzle passing through the nozzle plate and in flow communication with the ink chamber, and a first and a second heater and a first and a second conductor, each of which are interposed between adjacent layers of the plurality of passivation layers of the nozzle plate, the first and second heaters being disposed on the ink chamber and for heating ink stored in the ink chamber, the first and second conductors for conducting a current to the first and second heaters, wherein a material layer is interposed between the ink chamber and the manifold to form a bottom wall of the ink chamber and a top wall of the manifold, and a plurality of ink channels is formed in the material layer to provide flow communication between the ink chamber and the manifold.

The material layer may be a silicon oxide layer.

The substrate may be a silicon-on-insulator (SOI) substrate including a lower silicon substrate, an insulation layer, and an upper silicon substrate, which are sequentially stacked. The ink chamber may be formed in the upper silicon substrate, the manifold may be formed in the lower silicon substrate, and the plurality of ink channels may be formed in the insulation layer.

The material layer may have a thickness ranging from approximately 1 to 4 μm. Each of the plurality of ink channels may have a diameter ranging from approximately 1 to 4 μm.

The nozzle may be disposed at a position corresponding to a central portion of the ink chamber, and the first and second heaters may be disposed at opposite sides of the nozzle.

The nozzle may also be disposed at a first side of the ink chamber and the heater may be disposed at a second side of the ink chamber.

The nozzle may also be offset from a lengthwise center of the ink chamber in a first direction and the first and second heaters may be offset from the lengthwise center of the ink chamber in a second direction, wherein the first direction and the second direction are opposite.

The plurality of passivation layers may include a first passivation layer, a second passivation layer, and a third passivation layer, which are sequentially stacked on the substrate, and the first and second heaters may be interposed between the first passivation layer and the second passivation layer and the first and second conductors may be interposed between the second passivation layer and the third passivation layer.

The nozzle may further include a lower portion of the nozzle formed in the plurality of passivation layers and an upper portion of the nozzle formed in the heat dissipation layer. The upper portion of the nozzle formed in the heat dissipation layer may have a tapered shape having a sectional area that decreases toward an outlet of the nozzle.

The heat dissipation layer may be made of at least one material selected from the group consisting of nickel (Ni), copper (Cu), aluminum (Al), and gold (Au). The heat dissipation layer may have a thickness ranging from approximately 10 to 100 μm.

The heat dissipation layer may be in thermal contact with a top surface of the substrate through a contact hole formed in the plurality of passivation layers.

The printhead may further include a seed layer, for electroplating the heat dissipation layer, formed on the plurality of passivation layers. The seed layer may be formed of at least one metal material selected from the group consisting of copper (Cu), chromium (Cr), titanium (Ti), gold (Au), and nickel (Ni).

The plurality of ink channels formed in the material layer may serve to filter an impurity from ink flowing into the ink chamber. A diameter of each of the plurality of ink channels may be smaller than a size of the impurity.

BRIEF DESCRIPTION OF THE DRAWINGS

The above and other features and advantages of the present invention will become more apparent to those of ordinary skill in the art by describing in detail exemplary embodiments thereof with reference to the attached drawings in which.

DETAILED DESCRIPTION OF THE INVENTION

Figure 1:
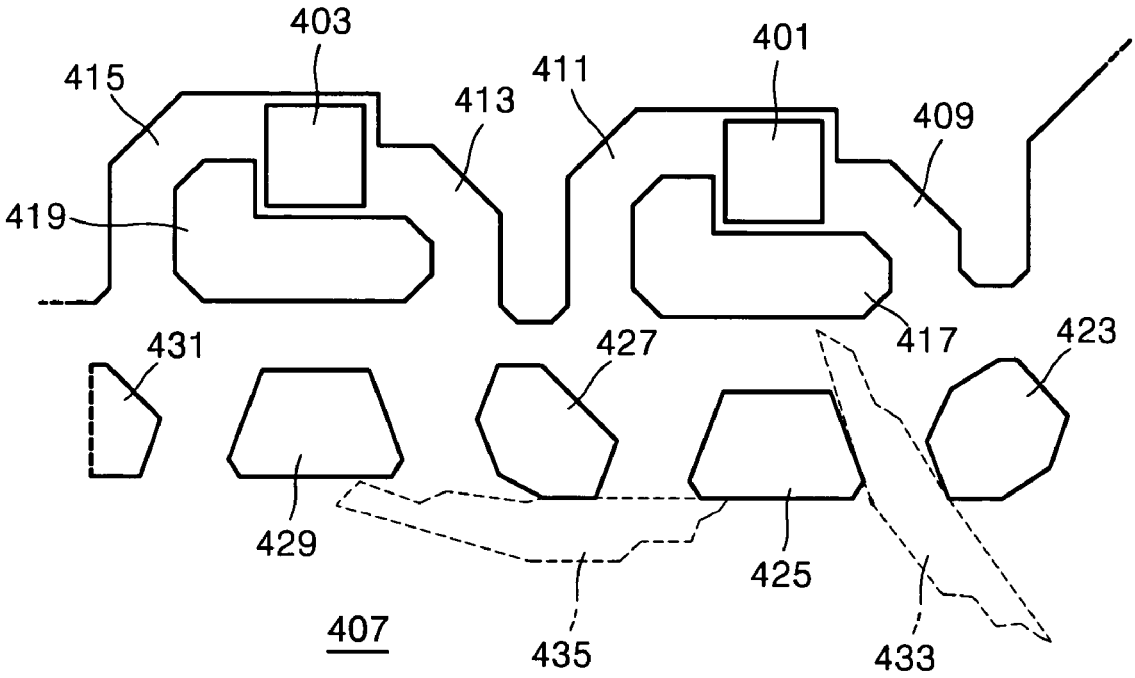
FIG. 1 (PRIOR ART)
FIG. 1 illustrates a plan view of a conventional ink-jet printhead.

Korean Patent Application No. 2003-44841, filed on Jul. 3, 2003, in the Korean Intellectual Property Office, and entitled: "Inkjet Printhead," is incorporated by reference herein in its entirety.

The present invention will now be described more fully hereinafter with reference to the accompanying drawings, in which exemplary embodiments of the invention are shown. The invention may, however, be embodied in different forms and should not be construed as limited to the embodiments set forth herein. Rather, these embodiments are provided so that this disclosure will be thorough and complete, and will fully convey the scope of the invention to those skilled in the art. In the figures, the dimensions of layers and regions are exaggerated for clarity of illustration. It will also be understood that when a layer is referred to as being "on" another layer or substrate, it can be directly on the other layer or substrate, or intervening layers may also be present. Further, it will be understood that when a layer is referred to as being "under" another layer, it can be directly under, and one or more intervening layers may also be present. In addition, it will also be understood that when a layer is referred to as being "between" two layers, it can be the only layer between the two layers, or one or more intervening layers may also be present. Like reference numerals refer to like elements throughout.

Figure 2:
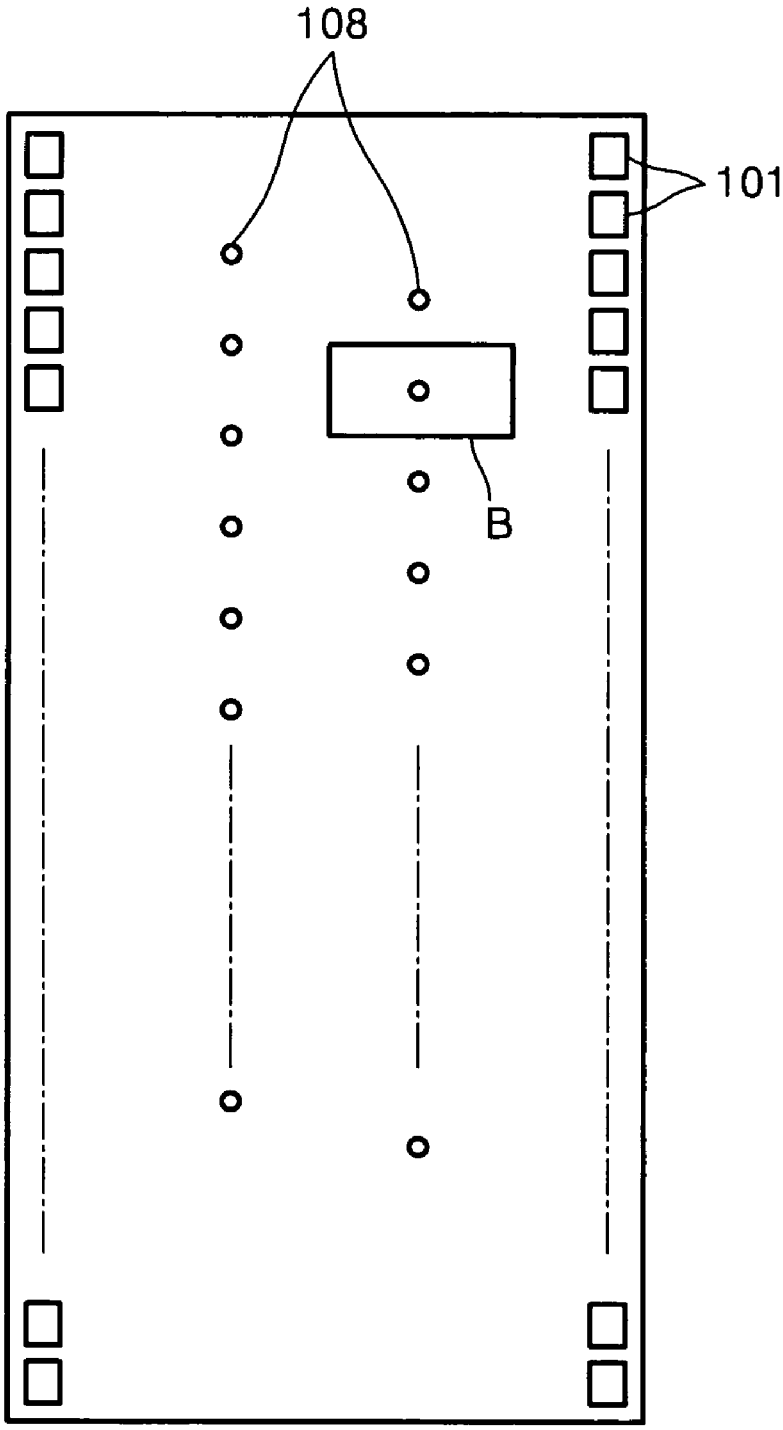
FIG. 2 schematically illustrates a plan view of an ink-jet printhead according to a first embodiment of the present invention.

FIG. 2 schematically illustrates a plan view of an ink-jet printhead according to a first embodiment of the present invention.

Referring to FIG. 2, the ink-jet printhead, which is manufactured in the form of a chip, includes a plurality of nozzles 108 exemplarily arranged on a top surface thereof in two rows and bonding pads 101, which are bonded with wires, arranged at both edge portions thereof. While the nozzles 108 are arranged in two rows in FIG. 2, in alternative embodiments, they may be arranged in a single row or they may be arranged in three or more rows to improve printing resolution.

Figure 3:
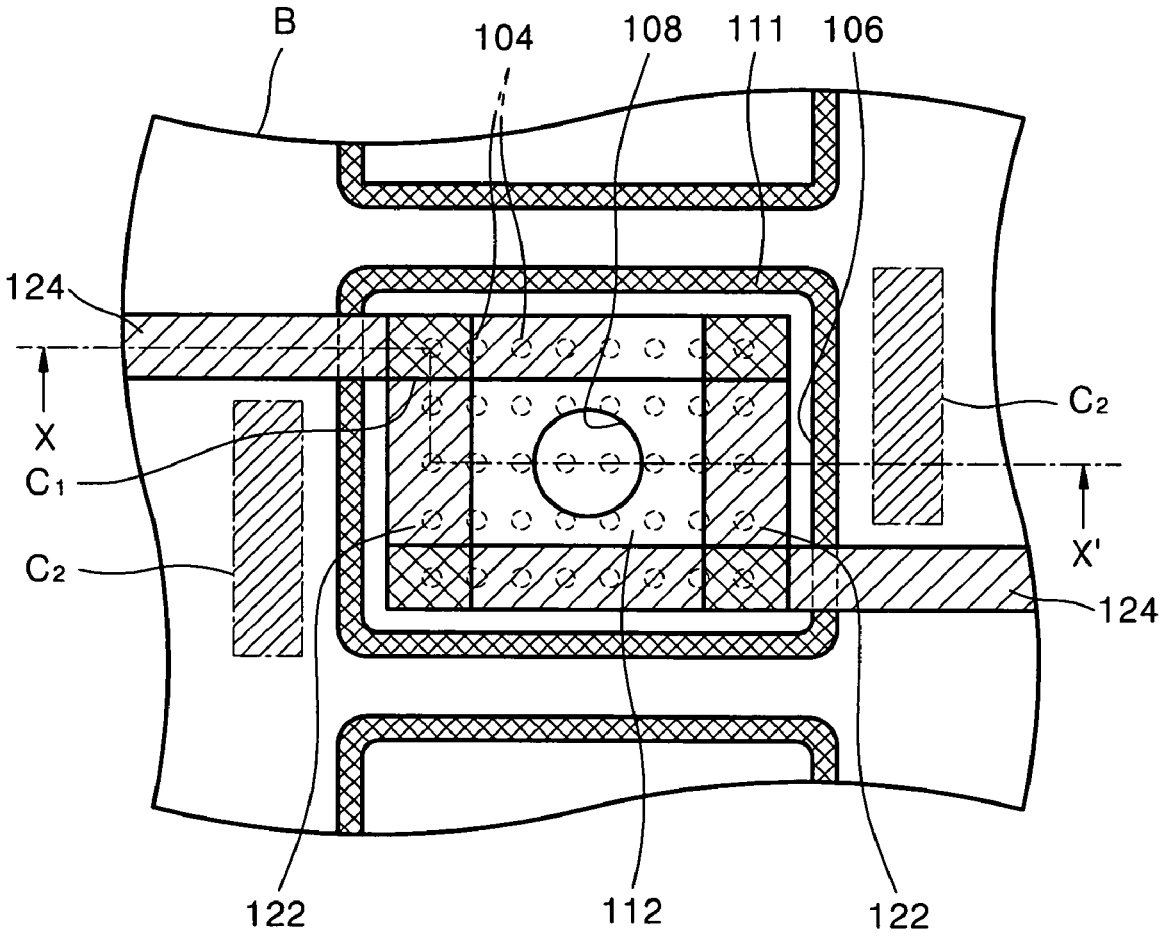
FIG. 3 illustrates an enlarged plan view of an area marked by a box 'B' in FIG. 2.
Figure 4:
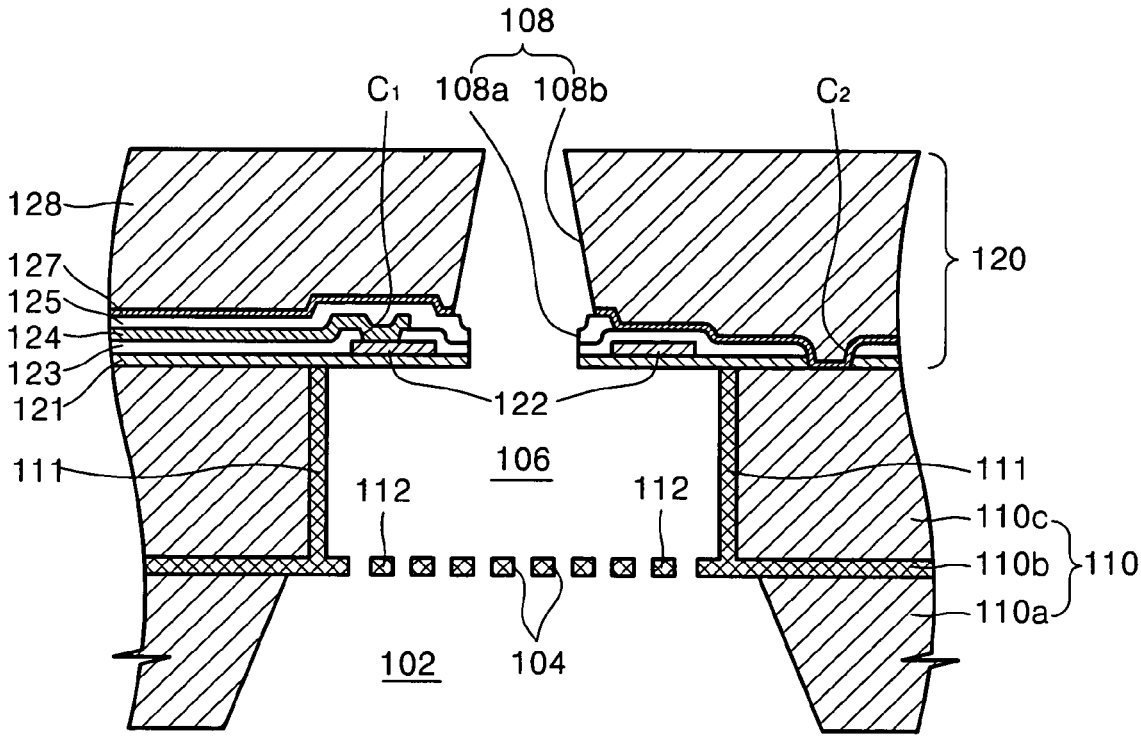
FIG. 4 illustrates a cross-sectional view of the ink-jet printhead according to the first embodiment of the present invention, taken along the line X–X' of FIG. 3.

FIG. 3 illustrates an enlarged plan view of an area marked by a box "B" in FIG. 2. FIG. 4 illustrates a cross-sectional view of the ink-jet printhead according to the first embodiment of the present invention, taken along the line X–X' of FIG. 3.

Referring to FIGS. 3 and 4, the ink-jet printhead according to the first embodiment of the present invention includes a substrate 110 and a nozzle plate, which is stacked on the substrate 110.

The substrate 110 includes an ink chamber 106 to be filled with ink to be ejected that is formed in an upper portion thereof, and a manifold 102 for supplying ink to the ink chamber 106 that is formed in a lower portion thereof. A plurality of ink channels 104 is formed between the ink chamber 106 and the manifold 102 and functions as paths through which the ink is supplied to the ink chamber 106. The ink channels 104 are formed in a predetermined material layer 110*b*, which is interposed between the ink chamber 106 and the manifold 102. The material layer 110*b* may be a silicon oxide layer. The material layer 110*b* may have a thickness of approximately 1 to 4 μm.

The substrate 110 may be a silicon-on-insulator (SOI) substrate in which a lower silicon substrate 110*a,* the material layer 110*b,* which is an insulation layer, and an upper silicon substrate 110*c* are sequentially stacked. In the 501 substrate 110, the manifold 102 is formed in the lower silicon substrate 110*a* and the ink chamber 106 is formed in the upper silicon substrate 110*c.* The plurality of ink channels 104 is formed in the insulation layer 110*b* that is interposed between the lower silicon substrate 110*a* and the upper silicon substrate 110*c*. The insulation layer 110*b* may have a thickness of approximately 1 to 4 μm.

The ink chamber 106, in which the ink to be ejected is stored, may be formed by isotropically etching the upper silicon substrate 110*c* of the SOI substrate 110. The ink chamber 106 has lateral surfaces, which are defined by lateral sidewalls 111 defining a shape and an area of the ink chamber 106, and a bottom surface, which is defined by a bottom wall 112 defining a depth of the ink chamber 106. The lateral sidewalls 111 may be formed by filling silicon oxide into trenches that are created when the upper silicon substrate 110*c* of the SOI substrate 110 is etched in a predetermined shape. The bottom wall 112 may include the insulation layer 110*b* of the SOI substrate 110. In that arrangement, the insulation layer 110*b* may form the bottom wall of the ink chamber 106 and also form an upper wall of the manifold 102.

The lateral sidewalls 111 and the bottom wall 112 act as etch-stop walls when the upper silicon substrate 110*c* is etched to form the ink chamber 106. The ink chamber 106 may be made precisely according to desired specifications due to the presence of the lateral sidewalls 111 and the bottom wall 112. More specifically, the ink chamber 106 may have an optimal volume that is sufficiently large to contain an amount of ink for ejecting a relatively large-sized ink droplet, i.e., the ink chamber 106 may have an optimal area and depth. Further, if the ink chamber 106 is formed to contain a large amount of ink, a large amount of ink is necessarily present around heaters 122. Accordingly, an increase in the temperature of the heaters 122 is reduced.

The ink chamber 106 defined by the lateral sidewalls 111 may have various shapes. In particular, the ink chamber 106 may have a square shape, or may have a substantially rectangular shape that is short in a direction in which the nozzles 108 are arranged and long in a direction perpendicular to the direction in which the nozzles 108 are arranged. If the width of the ink chamber 106 decreases in the direction in which the nozzles 108 are arranged, intervals between the nozzles 108 are reduced. Accordingly, the plurality of nozzles 108 can be densely arranged and an ink-jet printhead having a high DPI can be realized to perform high-resolution printing.

The manifold 102 may be formed by wet or dry etching the lower silicon substrate 110*a* of the SOI substrate 110 until a bottom surface of the insulation layer 110*b* is exposed. The manifold 102 is in flow communication with an ink container (not shown) in which the ink is contained, and supplies the ink to the ink chamber 106 from the ink container.

The plurality of ink channels 104 passes through the bottom wall 112, which includes the insulation layer 110*b*, of the ink chamber 106 to provide flow communication between the ink chamber 106 and the manifold 102. Tens or hundreds of ink channels 104 may be formed in the bottom wall 112 of the ink chamber 106. The ink channels 104 are paths through which the ink is supplied from the manifold 102 to the ink chamber 106.

Figure 5:
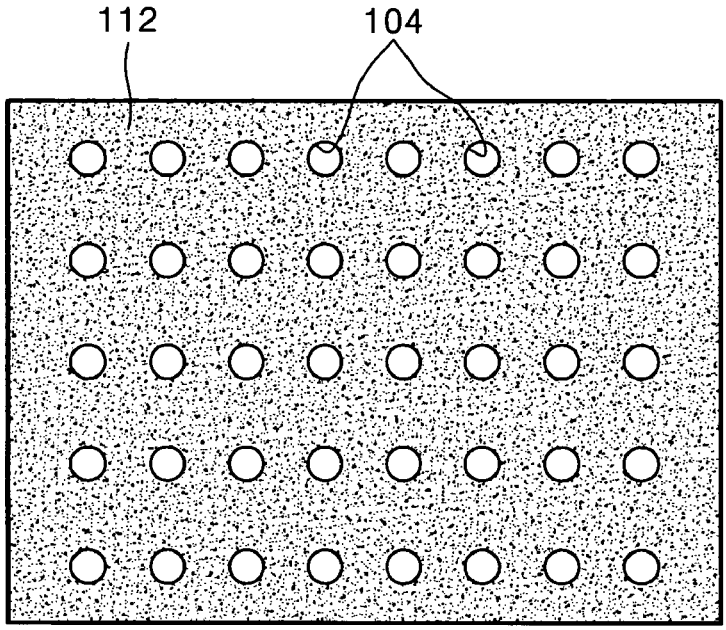
FIG. 5 illustrates a plan view of a bottom wall of an ink chamber, in which a plurality of ink channels is formed, of the ink-jet printhead of FIG. 4.
Figure 6:
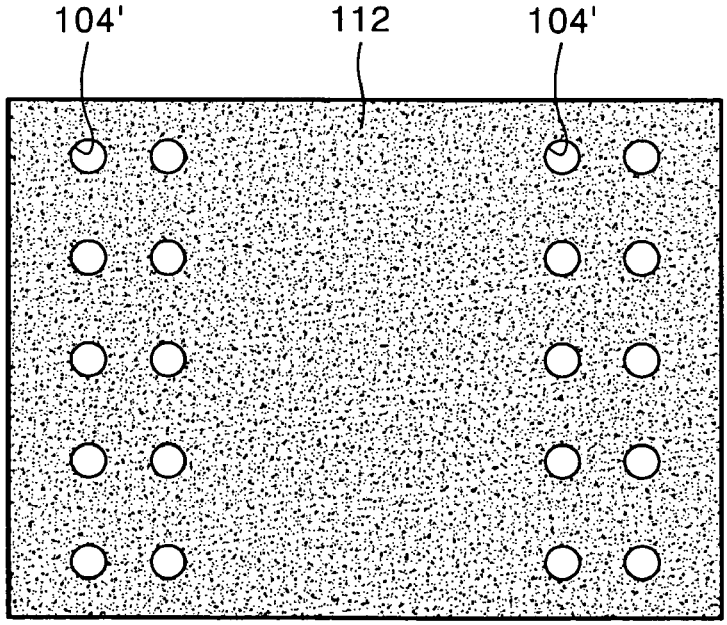
FIG. 6 illustrates a plan view of another bottom wall of the ink chamber applicable to the present invention.

FIG. 5 illustrates a plan view of a state wherein the plurality of channels 104 is formed in the bottom wall 112, which includes the insulation layer 110*b*, of the ink chamber 106. FIG. 6 illustrates a plan view of another bottom wall of the ink chamber applicable to the present invention.

Referring to FIG. 5, the plurality of ink channels 104 having a predetermined diameter are uniformly formed in the bottom wall 112 of the ink chamber 106. Although the diameter of the ink channels 104 may range from approximately 1 to 4 μm, the number and diameter of the ink channels 104 may be varied according to design conditions of the printhead. The arrangement of the ink channels 104 formed in the bottom wall 112 of the ink chamber 106 may also be changed from that illustrated in FIG. 5. For example, as shown in FIG. 6, a plurality of ink channels may be formed only at edge portions of the bottom wall 112 of the ink chamber 106 depending on the design conditions of the printhead.

As described previously, if the plurality of ink channels 104 providing flow communication between the ink chamber 106 and the manifold 102 is formed in the bottom wall 112 of the ink chamber 106, ink flow resistance is changed according to fluid velocity. More specifically, when ink is ejected, the velocity of ink flowing back toward the manifold 102 is high and flow resistance increases. Therefore, the mobility of ink droplets ejected through the nozzles 108 increases. When the ink is refilled, the velocity of ink introduced into the ink chamber 106 from the manifold 102 is low and flow resistance decreases. Therefore, the time necessary to refill the ink chamber 106 with new ink is reduced, thereby increasing an operating frequency of the printhead.

During operation, if impurities enter into the ink chamber 106 from the manifold 102, the impurities will block the nozzles 108, leading to a malfunction of the printhead. If the plurality of ink channels 104 is formed in the bottom wall 112 of the ink chamber 106, however, the ink channels 104 may also serve as filters so that the impurities present in the manifold 102 can be prevented from entering into the ink chamber 106.

Since the insulation layer 110*b* of the SOI substrate 110 is made of silicon oxide and has a predetermined thickness, the ink channels 104 formed in the insulation layer 110*b* have a predetermined length. Consequently, the ink channels 104 are not affected by a process error and thus can maintain uniform flow resistance at any place on a wafer.

Referring back to FIGS. 3 and 4, the nozzle plate 120 is formed on the SOI substrate 110 in which the ink chamber 106, the plurality of ink channels 104, and the manifold 102 are formed. The nozzle plate 120 forms the upper wall of the ink chamber 106. The nozzle 108 passes through the nozzle plate 120 at a position corresponding to a central portion of the ink chamber 106 such that the ink is ejected from the ink chamber 106 through the nozzle 108.

The nozzle plate 120 includes a plurality of material layers stacked on the SOI substrate 110. The material layers include a first passivation layer 121, a second passivation layer 123, a third passivation layer 125, and a heat dissipation layer 128. The heaters 122, e.g., a first and a second heater, are interposed between the first passivation layer 121 and the second passivation layer 123. Conductors 124, e.g., a first and a second conductor, are interposed between the second passivation layer 123 and the third passivation layer 125.

The first passivation layer 121 is the lowest material layer of the plurality of material layers constituting the nozzle plate 120, and is formed on the substrate 110. The first passivation layer 121 provides insulation between the heaters 122 and the substrate 110 and protects the heaters 122. The first passivation layer 121 may be made of silicon oxide or silicon nitride.

Figure 7:
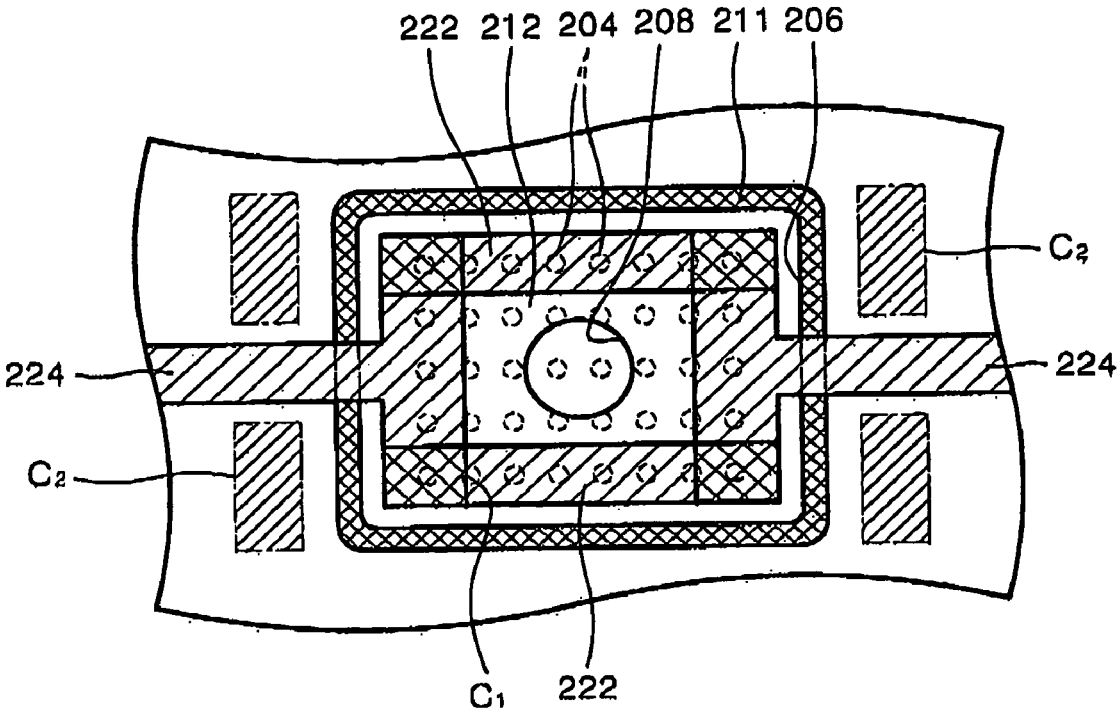
FIG. 7 illustrates a plan view of an ink-jet printhead according to a second embodiment of the present invention.

The heaters 122 are disposed on the first passivation layer 121 over the ink chamber 106 to heat the ink stored in the ink chamber 106. The heaters 122 may be heating resistors made of polysilicon doped with impurities, tantalum-aluminium alloy, tantalum nitride, titanium nitride, or tungsten silicide. The heaters 122 may be disposed at opposite sides of each of the nozzles 108, and extend in either a widthwise direction as shown in FIG. 3 or in a lengthwise direction as shown in FIG. 7. The heaters 122 may have a square shape, or may have a substantially rectangular shape that is long in the direction in which the nozzles 108 are arranged. Alternatively, only a single heater may be provided, and the arrangement or shape of the heaters 122 may be different from that illustrated in FIG. 3. For example, a heater may have an annular shape surrounding the nozzle 108.

The second passivation layer 123 is formed on the first passivation layer 121 and the heaters 122. The second passivation layer 123 provides insulation between the heat dissipation layer 128 and the heaters 122 and protects the heaters 122. The second passivation layer 123 may be made of silicon nitride or silicon oxide, similar to the first passivation layer 121.

The conductors 124 are formed on the second passivation layer 123 and are electrically connected to the heaters 122 to conduct a pulse current to the heaters 122. Each of the conductors 124 has a first end connected to both ends of the heaters 122 through first contact holes $C_1$, which are formed in the second passivation layer 123, and a second end electrically connected to a corresponding one of the bonding pads 101. The conductors 124 may be made of a material having high conductivity, e.g., a metal, such as aluminium (Al), an aluminium alloy, gold (Au), or silver (Ag).

The third passivation layer 125 may be formed on the conductors 124 and the second passivation layer 123. The third passivation layer 125 may be made of tetraethylorthosilicate (TEOS) oxide, silicon oxide, or silicon nitride. The third passivation layer 125 may be formed on the conductors 124 and portions adjacent to the conductors 124, but not formed on other portions, e.g., the heaters 122, to avoid deterioration of the insulation capacity of the third passivation layer 125. This is because the interval between the heat dissipation layer 128 and the heaters 122 and the interval between the heat dissipation layer 128 and the substrate 110 are reduced. Accordingly, the heat dissipating capability of the heat dissipation layer 128 can be improved. Even in this case, the insulation between the heat dissipation layer 128 and the heaters 122 can be ensured by the second passivation layer 123.

The heat dissipation layer 128 is formed on the third passivation layer 125 and the second passivation layer 123, and thermally contacts a top surface of the SOI substrate 110 through second contact holes $C_2$ that pass through the second passivation layer 123 and the first passivation layer 121. The heat dissipation layer 128 may be made of at least one material, e.g., a metal, having high thermal conductivity, such as nickel (Ni), copper (Cu), aluminium (Al), or gold (Au). The heat dissipation layer 128 may be formed on the third passivation layer 125 and the second passivation layer 123 by electroplating the selected metal material to have a relatively large thickness of approximately 10 to 100 μm. A seed layer 127 may be formed on the third passivation layer 125 and the second passivation layer 123 to be used in electroplating the metal material. The seed layer 127 may be made of at least one metal material having a high electrical conductivity, such as copper (Cu), chromium (Cr), titanium (Ti), gold (Au), or nickel (Ni).

Because the heat dissipation layer 128 made of the metal material is formed using a plating process, as described above, it can be integrally formed with other elements of the ink-jet printhead. Also, since the heat dissipation layer 128 has a relatively large thickness, effective heat dissipation can be achieved.

The heat dissipation layer 128 is in thermal contact with the top surface of the SOI substrate 110 through the second contact holes $C_2$ and transfers heat from and around the heaters 122 to the SOI substrate 110. That is, after the ink is ejected, heat generated from and heat that is remaining around the heaters 122 is transferred to the SOI substrate 110 and dissipated out of the printhead through the heat dissipation layer 128. As a consequence, since heat is dissipated rapidly and the temperature around the nozzle 108 decreases quickly after ejection of the ink, stable printing can be performed at a high operating frequency.

Further, since the heat dissipation layer 128 has a relatively large thickness, the nozzle 108 can be made relatively long, thereby enabling stable printing at a high speed and improving a linearity of the ink droplet ejected through the nozzle 108. More specifically, the ejected ink droplet can be ejected exactly perpendicular to the surface of the SOI substrate 110.

The nozzle 108, which includes a lower nozzle **108*a* and an upper nozzle 108*b*, passes through the nozzle plate 120. The lower nozzle 108*a* has a cylindrical shape and passes through the first, second, and third passivation layers 121, 123, and 125 of the nozzle plate 120. The upper nozzle 108*b* passes through the heat dissipation layer 128. The upper nozzle 108*b* may have a cylindrical shape, or may have a tapered shape having a sectional area that decreases toward an outlet of the nozzle 108, as shown in FIG. 4. If the upper nozzle 108*b*** is formed to have the tapered shape, a meniscus on a surface of the ink is stabilized more rapidly after an ink droplet is ejected.

FIG. 7 illustrates a plan view of an ink-jet printhead according to a second embodiment of the present invention. The ink-jet printhead depicted in FIG. 7 is similar in structure to the first embodiment depicted in FIGS. 3 and 4, and therefore, only a brief explanation focusing on a difference between the first and second embodiments will now be provided.

Referring to FIG. 7, an ink chamber 206 defined by lateral sidewalls 211 and a bottom wall 212 may have a square shape, or may have a substantially rectangular shape that is short in a direction in which nozzles 208 are arranged and long in a direction perpendicular to the direction in which the nozzles 208 are arranged. Each of the nozzles 208 is located at a position corresponding to a central portion of the ink chamber 206. A plurality of ink channels 204 is formed in the bottom wall 212 of the ink chamber 206. Heaters 222 are placed on the ink chamber 206 and disposed to extend in a lengthwise direction at opposite sides of the nozzle 208. The heaters 222 may have a square shape, or may have a substantially rectangular shape that is long in a direction parallel to the longitudinal direction of the ink chamber 206. Conductors 224 are respectively electrically connected to both ends of the heaters 222 through first contact holes $C_1$. Second contact holes $C_2$ are formed on both sides of the ink chamber 206 to thermally connect the heat dissipation layer 128 of FIG. 4 to the SOI substrate 110 of FIG. 4.

Figure 8:
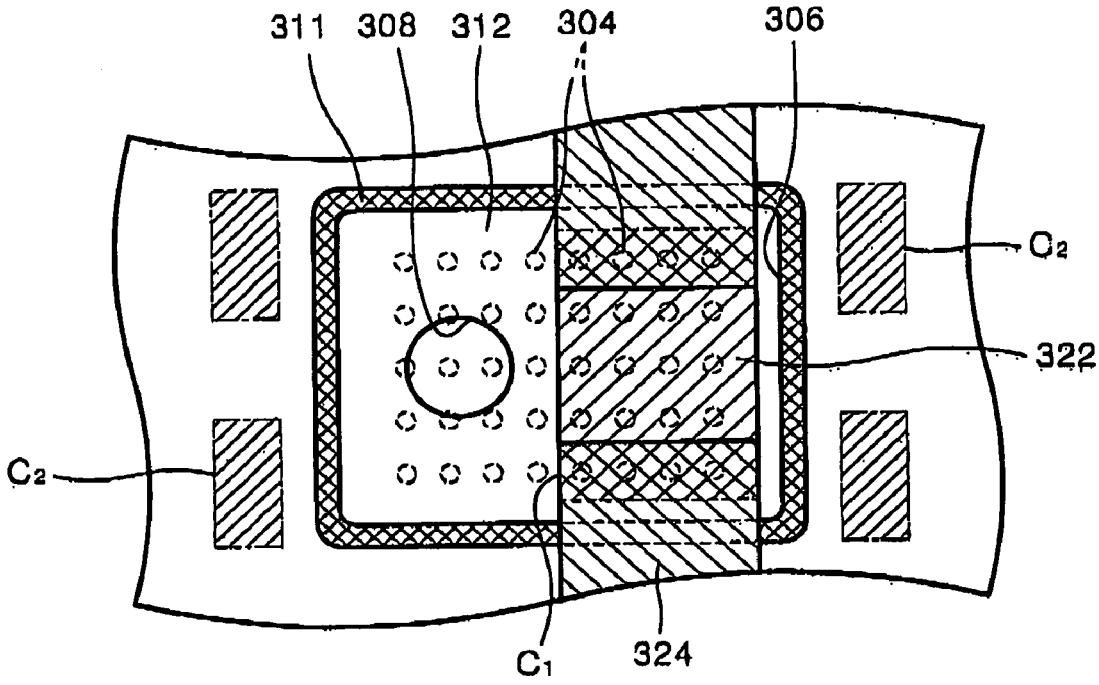
FIG. 8 illustrates a plan view of an ink-jet printhead according to a third embodiment of the present invention.

FIG. 8 illustrates a plan view of an ink-jet printhead according to a third embodiment of the present invention. The ink-jet printhead depicted in FIG. 8 is similar in structure to the first embodiment depicted in FIGS. 3 and 4, and therefore, only a brief explanation focusing on a difference between the first and third embodiments will now be provided.

Referring to FIG. 8, an ink chamber 306 defined by lateral sidewalls 311 and a bottom wall 312 may have a square shape, or may have a substantially rectangular shape that is short in the direction in which nozzles 308 are arranged and long in a direction perpendicular to the direction in which the nozzles 308 are arranged. A plurality of ink channels 304 is formed in the bottom wall 312 of the ink chamber 306. Each of the nozzles 308 is disposed at a first side of the ink chamber 306 and a heater 322 is disposed at a second side, which is opposite to the first side, of the ink chamber 306. The heater 322 may have a square shape, or may have a substantially rectangular shape that is long in a direction parallel to the width direction of the ink chamber 306. Conductors 324 are electrically connected to both ends of the heater 322 through first contact holes $C_1$. Second contact holes $C_2$ are formed on both sides of the ink chamber 306 to thermally connect the heat dissipation layer 128 of FIG. 4 to the SOI substrate 110 of FIG. 4.

An ink ejection mechanism in the ink-jet printhead of FIG. 4 will now be explained below with reference to FIGS. 9A through 9D.

Figure 9A:
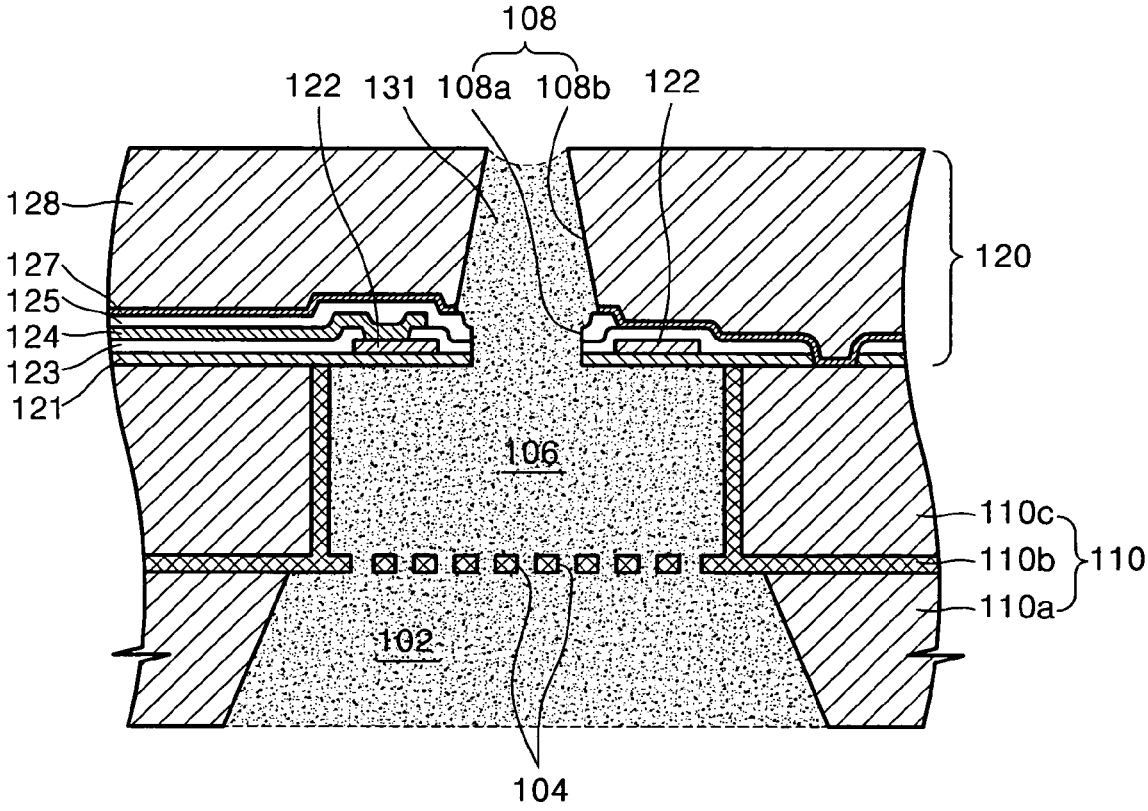
FIGS. 9A through 9D illustrate cross-sectional views for explaining states in an ink ejection mechanism of the ink-jet printhead of FIG. 4.
Figure 9B:
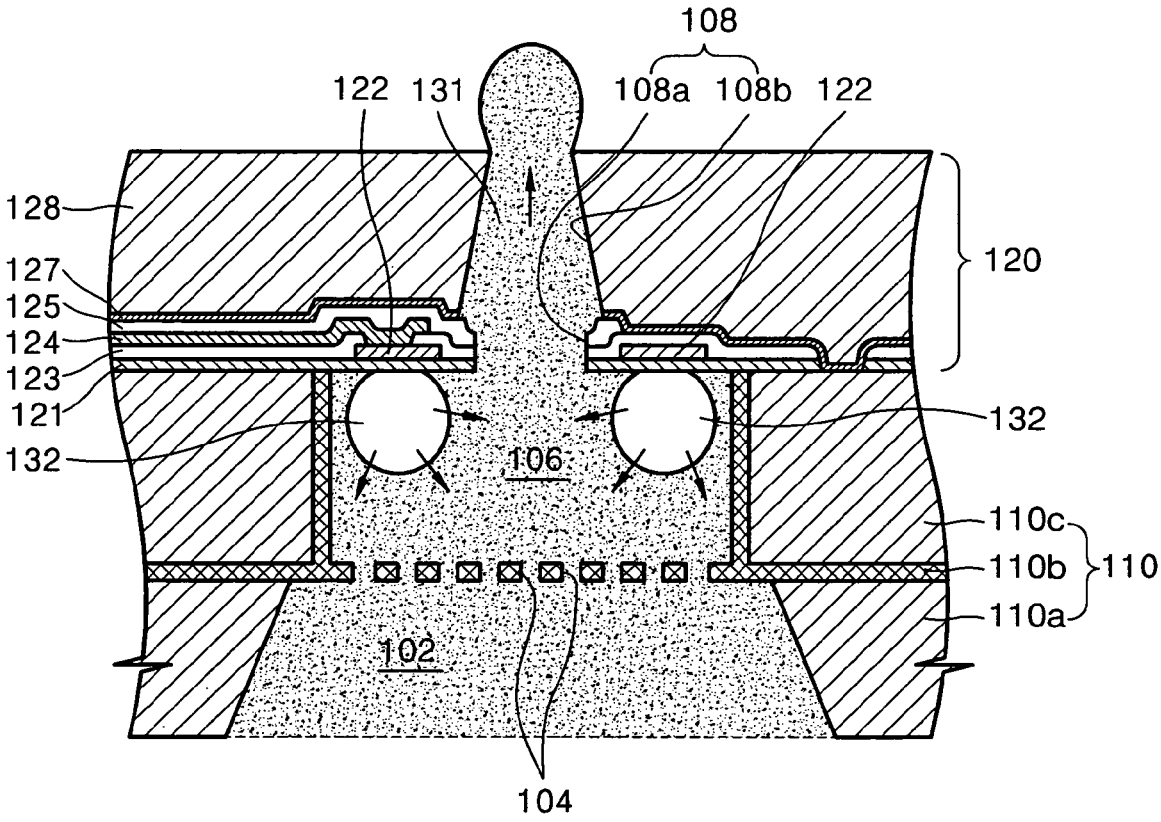

Referring to FIG. 9A, in a state where ink 131 fills the ink chamber 106 and the nozzle 108, if a pulse current is applied to the heaters 122 through the conductors 124, heat is generated by the heaters 122. The generated heat is transferred to the ink 131 in the ink chamber 106 through the first passivation layer 121 that is formed under the heaters 122. Accordingly, as shown in FIG. 9B, the ink 131 boils to generate bubbles 132. The generated bubbles 132 expand due to the continuous heat supply, and thus the ink 131 in the nozzle 108 is pushed out of the nozzle 108. When the ink flows back at a high speed toward the manifold 102 from the ink chamber 106, flow resistance increases because of the plurality of ink channels 104 formed in the bottom wall 112 of the ink chamber 106. Thus, the mobility of the ink forcibly pushed out of the nozzle 108 is improved.

Figure 9C:
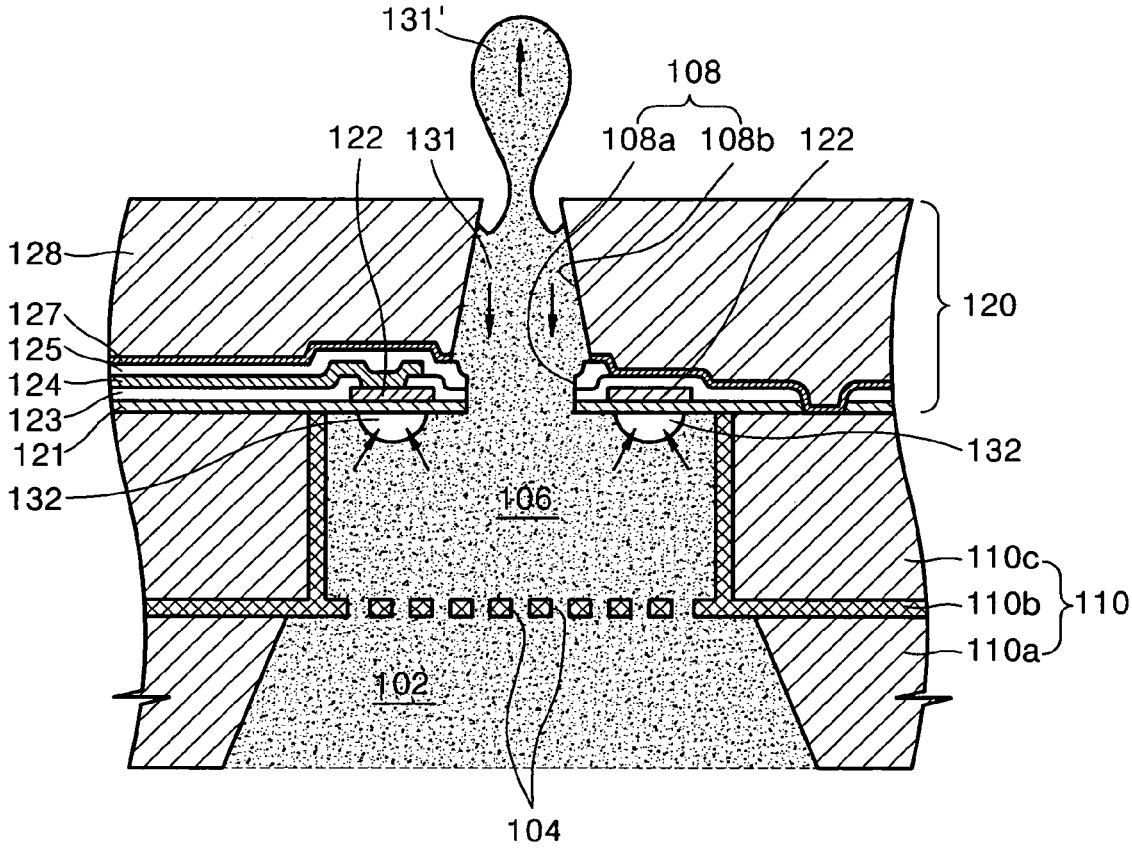

Referring to FIG. 9C, if the applied current is cut off when the bubbles 132 are maximally expanded, the bubbles 132 start to contract and finally burst. At this time, a cavitation pressure is formed inside the ink chamber 106, such that the ink 131 inside the nozzle 108 flows back to the ink chamber 106. At the same time, the portion of ink pushed out of the nozzle 108 is separated from the ink 131 filled in the nozzle 108 and is ejected in the form of an ink droplet 131' due to an inertial force.

After the ink droplet 131' is separated, a meniscus formed on a surface of the ink 131 in the nozzle 108 recedes toward the ink chamber 106. Since the nozzle 108 has a sufficient length due to the relatively thick nozzle plate 120, the meniscus only recedes into the nozzle 108, and does not reach the ink chamber 106. As a consequence, outside air is prevented from entering into the ink chamber 106, and the meniscus quickly returns to an initial state thereof, which results in stable high-speed ejection of the ink droplet 131'. In addition, since the heat generated by and remaining around the heaters 122 is dissipated to the substrate 110 or out of the printhead through the heat dissipation layer 128 after the ink droplet 131' is ejected, the temperature of and around the heaters 122 and the nozzle 108 decreases rapidly.

Figure 9D:
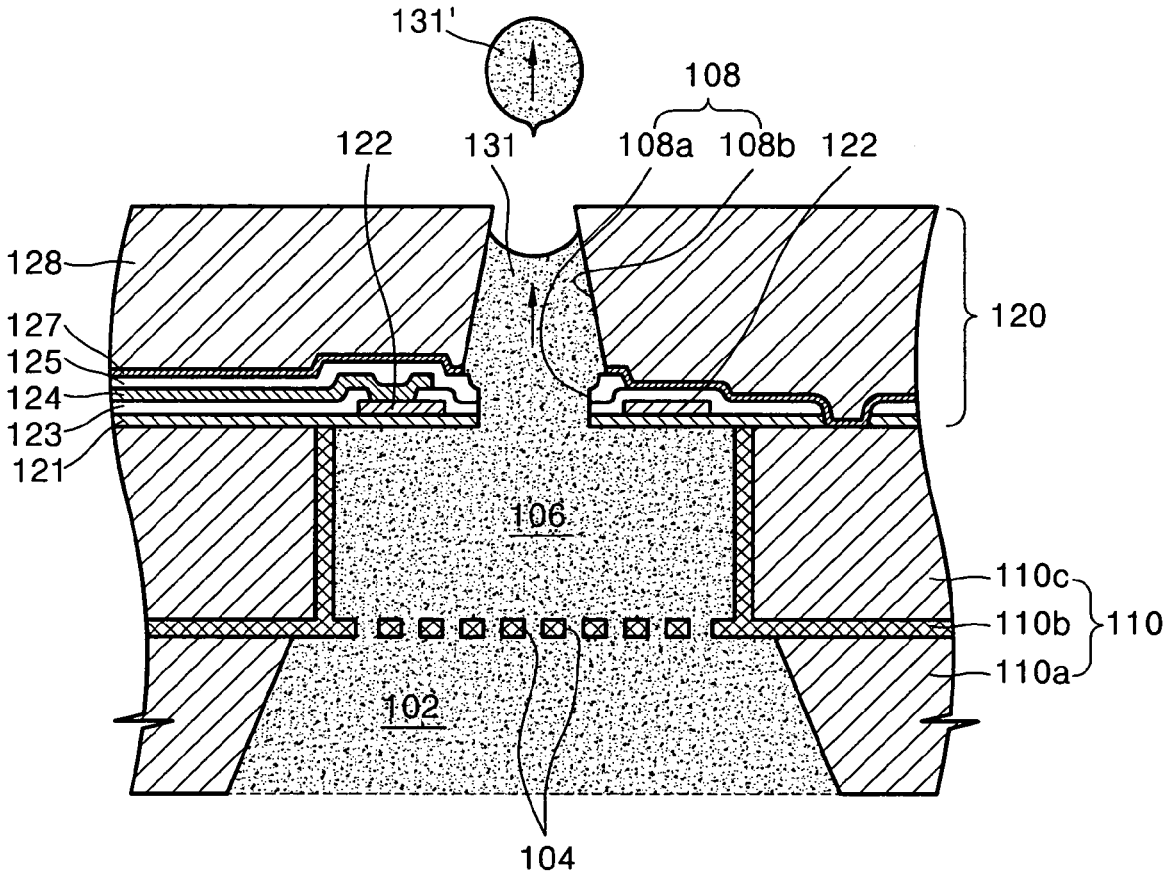

Referring to FIG. 9D, when the cavitation pressure inside the ink chamber 106 dissipates, the ink 131 rises toward the outlet of the nozzle 108 again due to surface tension applied to the meniscus formed inside the nozzle 108. If the upper nozzle **108*b* is formed to have the tapered shape, the ink 131 rises faster than an upper nozzle having a cylindrical shape. Accordingly, the ink chamber 106 is refilled with new ink supplied through the ink channels 104. When the ink is introduced at a low speed to the ink chamber 106 from the manifold 102, flow resistance decreases because of the plurality of ink channels 104 formed in the bottom wall 112 of the ink chamber 106, thereby increasing a velocity at which the ink is refilled. Furthermore, the ink channels 104 serve as filters to prevent impurities present in the manifold 102 from entering into the ink chamber 106. Subsequently, when the ink 131 is completely refilled in the ink chamber 106 and the printhead returns to an initial state, the aforesaid steps are repeated. In those steps, since heat dissipation is performed by the heat dissipation layer 128**, the printhead cools quickly and returns to the initial state rapidly.

As described above, the ink-jet printhead according to the present invention has the following several advantages.

First, when ink is ejected, because the flow resistance of the ink channels is high, the mobility of the ink droplet ejected through the nozzle is improved. When the ink is refilled, since the flow resistance of the ink channels is low, the time required to refill the ink into the ink chamber is reduced, thereby increasing the operating frequency of the printhead.

Second, since impurities contained in the ink are prevented from entering into the ink chamber, malfunction of the printhead may be avoided.

Third, since an SOI substrate including an oxide layer having a predetermined thickness may be used as the substrate, uniform flow resistance is ensured at any place on a wafer.

Fourth, since a greater amount of ink is present around the heaters, as compared to conventional printheads, an overall increase in the temperature of the heaters is reduced.

Exemplary embodiments of the present invention have been disclosed herein and, although specific terms are employed, they are used and are to be interpreted in a generic and descriptive sense only and not for purpose of limitation. For example, each element of the ink-jet printhead may be made of a material other than those mentioned. Furthermore, the specific figures suggested in each step are variable within the range of enabling the manufactured ink-jet printhead to operate normally. Accordingly, it will be understood by those of ordinary skill in the art that various changes in form and details may be made without departing from the spirit and scope of the present invention as set forth in the following claims.

What is claimed is:

1. An ink-jet printhead, comprising:

a substrate having an ink chamber to be filled with ink to be ejected formed in an upper portion thereof and a manifold for supplying ink to the ink chamber formed in a lower portion thereof;

a nozzle plate formed on the substrate, the nozzle plate including a plurality of passivation layers formed of an insulating material, a heat dissipation layer formed on the plurality of passivation layers and made of a thermally conductive material, and a nozzle passing through the nozzle plate and in flow communication with the ink chamber; and a first and a second heater and a first and a second conductor, each of which are interposed between adjacent layers of the plurality of passivation layers of the nozzle plate, the first and second heaters being disposed on the ink chamber and for heating ink stored in the ink chamber, the first and second conductors for conducting a current to the first and second heaters, wherein a material layer is interposed between the ink chamber and the manifold to form a bottom wall of the ink chamber and a top wall of the manifold, and a plurality of ink channels is formed in the material layer to provide flow communication between the ink chamber and the manifold.

2. The ink-jet printhead as claimed in claim 1, wherein the material layer is a silicon oxide layer.

3. The ink-jet printhead as claimed in claim 1, wherein the substrate is a silicon-on-insulator (SOI) substrate comprising a lower silicon substrate, an insulation layer, and an upper silicon substrate, which are sequentially stacked.

4. The ink-jet printhead as claimed in claim 3, wherein the ink chamber is formed in the upper silicon substrate, the manifold is formed in the lower silicon substrate, and the plurality of ink channels are formed in the insulation layer.

5. The ink-jet printhead as claimed in claim 1, wherein the material layer has a thickness ranging from approximately 1 to 4 μm.

6. The ink-jet printhead as claimed in claim 1, wherein each of the plurality of ink channels has a diameter ranging from approximately 1 to 4 μm.

7. The ink-jet printhead as claimed in claim 1, wherein the nozzle is disposed at a position corresponding to a central portion of the ink chamber, and the first and second heaters are disposed at opposite sides of the nozzle.

8. The ink-jet printhead as claimed in claim 1, wherein the nozzle is disposed at a first side of the ink chamber and the heater is disposed at a second side of the ink chamber.

9. The ink-jet printhead as claimed in claim 8, wherein the nozzle is offset from a lengthwise center of the ink chamber in a first direction and the first and second heaters are offset from the lengthwise center of the ink chamber in a second direction, wherein the first direction and the second direction are opposite.

10. The ink-jet printhead as claimed in claim 1, wherein the plurality of passivation layers comprises a first passivation layer, a second passivation layer, and a third passivation layer, which are sequentially stacked on the substrate, and wherein the first and second heaters are interposed between the first passivation layer and the second passivation layer and the first and second conductors are interposed between the second passivation layer and the third passivation layer.

11. The ink-jet printhead as claimed in claim 1, the nozzle further comprising:

a lower portion of the nozzle formed in the plurality of passivation layers; and an upper portion of the nozzle formed in the heat dissipation layer.

12. The ink-jet printhead as claimed in claim 11, wherein the upper portion of the nozzle formed in the heat dissipation layer has a tapered shape having a sectional area that decreases toward an outlet of the nozzle.

13. The ink-jet printhead as claimed in claim 1, wherein the heat dissipation layer is formed of at least one material selected from the group consisting of nickel (Ni), copper (Cu), aluminum (Al), and gold (Au).

14. The ink-jet printhead as claimed in claim 1, wherein the heat dissipation layer has a thickness ranging from approximately 10 to 100 μm.

15. The ink-jet printhead as claimed in claim 1, wherein the heat dissipation layer is in thermal contact with a top surface of the substrate through a contact hole formed in the plurality of passivation layers.

16. The ink-jet printhead as claimed in claim 1, further comprising a seed layer, for electroplating the heat dissipation layer, formed on the plurality of passivation layers.

17. The ink-jet printhead as claimed in claim 16, wherein the seed layer is formed of at least one metal material selected from the group consisting of copper (Cu), chromium (Cr), titanium (Ti), gold (Au), and nickel (Ni).

18. The ink-jet printhead as claimed in claim 1, wherein the plurality of ink channels formed in the material layer serves to filter an impurity from ink flowing into the ink chamber.

19. The ink-jet printhead as claimed in claim 16, wherein a diameter of each of the plurality of ink channels is smaller than a size of the impurity.

* * * * *